US011173344B2

(12) United States Patent
Stehlik

(10) Patent No.: US 11,173,344 B2
(45) Date of Patent: Nov. 16, 2021

(54) VARIABLE DIFFICULTY BALANCE BOARD FOR STANDING DESK AND FITNESS USE

(71) Applicant: Robert Arnold Stehlik, Honolulu, HI (US)

(72) Inventor: Robert Arnold Stehlik, Honolulu, HI (US)

( * ) Notice: Subject to any disclaimer, the term of this patent is extended or adjusted under 35 U.S.C. 154(b) by 83 days.

(21) Appl. No.: 16/777,679

(22) Filed: Jan. 30, 2020

(65) Prior Publication Data

US 2020/0238135 A1 Jul. 30, 2020

Related U.S. Application Data

(60) Provisional application No. 62/798,819, filed on Jan. 30, 2019.

(51) Int. Cl.

| | |
|---|---|
| ***A63B 22/18*** | (2006.01) |
| ***A63B 21/00*** | (2006.01) |
| ***A63B 22/16*** | (2006.01) |
| ***A63B 22/00*** | (2006.01) |
| ***A63B 26/00*** | (2006.01) |

(52) U.S. Cl.

CPC ..... *A63B 26/003* (2013.01); *A63B 21/00178* (2013.01); *A63B 22/16* (2013.01); *A63B 22/18* (2013.01); *A63B 2022/0033* (2013.01); *A63B 2208/0204* (2013.01)

(58) Field of Classification Search

CPC ..... A63B 26/003–2026/006; A63B 22/16–18; A63B 22/0048; A63B 22/0056; A63B 22/0061

See application file for complete search history.

(56) References Cited

U.S. PATENT DOCUMENTS

| | | | | |
|---|---|---|---|---|
| 5,810,703 A | | 9/1998 | Stack | |
| 6,017,297 A | * | 1/2000 | Collins | A63B 26/003 482/146 |
| 6,945,920 B1 | * | 9/2005 | Kemery | A63B 21/0004 482/146 |
| 7,137,938 B2 | * | 11/2006 | Gottlieb | A63B 21/0004 482/146 |
| 7,300,392 B1 | | 11/2007 | Bentley | |

(Continued)

FOREIGN PATENT DOCUMENTS

WO WO2002038225 A1 5/2002

*Primary Examiner* — Jennifer Robertson
*Assistant Examiner* — Catrina A Letterman

(57) ABSTRACT

A variable difficulty balance board for standing desk and fitness use is provided. The balance board facilitates the conditioning and rehabilitation of the nerves, bones, muscles, and joints of the body by limiting the range of motion and biomechanical forces around the longitudinal and lateral axes. The balance board comprises a deck, a fulcrum receiver, and a fulcrum insert. The fulcrum insert is press-fit into a fulcrum cavity of the fulcrum receiver. The fulcrum insert extends outward from the fulcrum receiver and provides an area where the balance board can pivot. The fulcrum insert may be replaced by the user such that it may occupy either a first orientation or a second orientation within the fulcrum cavity. The first orientation and the second orientation configures the fulcrum insert such that it provides a lateral or longitudinal axis of balance relative to the deck, respectively.

11 Claims, 9 Drawing Sheets

(56) References Cited

U.S. PATENT DOCUMENTS

| | | | | |
|---|---|---|---|---|
| 7,833,145 | B2 * | 11/2010 | Ko | A63B 21/0552 482/142 |
| 8,936,539 | B2 * | 1/2015 | Richard | A63B 22/16 482/123 |
| 9,220,944 | B2 * | 12/2015 | Moscarello | A63B 26/003 |
| 9,533,187 | B2 * | 1/2017 | Dalebout | A63B 22/18 |
| 10,561,895 | B1 * | 2/2020 | Lee | A63B 22/16 |
| 2004/0009859 | A1 * | 1/2004 | Gottlieb | A63B 21/0004 482/146 |
| 2006/0105895 | A1 * | 5/2006 | Lu | A63B 21/0004 482/146 |
| 2008/0064578 | A1 * | 3/2008 | Huang | A63B 26/003 482/146 |
| 2019/0091510 | A1 * | 3/2019 | Wallace | A63B 26/003 |
| 2021/0016132 | A1 * | 1/2021 | Chang | A63B 26/003 |

* cited by examiner

VARIABLE DIFFICULTY BALANCE BOARD FOR STANDING DESK AND FITNESS USE

The current application claims a priority to the U.S. Provisional Patent application Ser. No. 62/798,819 filed on Jan. 30, 2019.

FIELD OF THE INVENTION

The present invention relates generally to the field of physical fitness. More specifically, the present invention is a variable difficulty balance board for standing desk and fitness use.

BACKGROUND OF THE INVENTION

Balance board platforms are often used to develop muscle strength, endurance, coordination, and balance by training the nervous system and improving muscular responses to perturbed or unstable joint positions. New users may use balance board platforms in a sitting or assisted position. More proficient users, however, may use balance board platforms in more challenging positions such as, but not limited to lateral/longitudinal balancing, weight-bearing exercise, oblique angles, or any other suitable method of use.

Balance board platforms must have a degree of instability that provokes a quick muscle response to have therapeutic effectiveness. In conventional systems, balance board platforms are oftentimes limited to a single degree of instability, limiting their therapeutic effectiveness. Additionally, users oftentimes have to carry multiple balance board platforms to suite their varying exercises, which can be cumbersome to travel or move with such as taking them to an exercise facility or on vacation.

It is an objective of the present invention to provide a modular balance board platform that is useful for users of varying skill, ranging from beginners to adept and athletic individuals. Additionally, it is an objective of the present invention to provide a balance board platform that suites a wide range of use, maximizing its therapeutic effectiveness.

SUMMARY OF THE INVENTION

The present invention is an all in one balance board apparatus that provides varying degrees of instability and pivot points. The balance board comprises a deck, a fulcrum receiver, and a fulcrum insert. The fulcrum receiver is connected to the bottom surface of the deck. The fulcrum insert is connected to a fulcrum cavity of a fulcrum receiver. The deck extends between a first deck end and a second deck end such that the user can position themselves to the top surface of the deck. The fulcrum insert extends outward from the fulcrum receiver and provides an area where the balance board can pivot. The fulcrum insert may be replaced by the user such that it may occupy either a first orientation or a second orientation along the fulcrum cavity. The first orientation positions the fulcrum insert such that it provides a lateral axis of balance along the deck. The second orientation positions the fulcrum insert such that it provides a longitudinal axis of balance along the deck. Additionally, the fulcrum insert may be removed such that the fulcrum receiver serves as the balance point, serving as the easiest degree of balancing difficulty. Furthermore, the fulcrum insert may be replaced with a different type of fulcrum insert to increase the degree of steepness, therefore increasing the degree of balancing difficulty that results in a more challenging and difficult exercise.

The balance boards instability stems from the curved surface at the bottom of the board. The easier balance setting only allows only left to right rocking motion at a bigger curve radius that is easier to balance on while the more difficult balance settings raise the balance board higher off the ground and have a smaller rocker radius that makes balancing more challenging. The more difficult settings allow left to right and front to back rocking motion, for a 360-degree balance challenge.

The invention consists of a rounded wood deck. The ends are curved up to allow comfortable balancing without the need of footwear. The deck is covered with cork or similar non-slip material to provide a grippy and slightly padded surface.

The bottom of the deck has routed handhold and rubber bumpers that allow the user to get on and off easily and without damaging floors. The bottom of the wood board has two curved wooden rails with a large curve radius that allow an easy left to right rocking motion. The rails are connected and reinforced by two wood stringers.

To make the balance workout more challenging, a plastic molded rocker module can be inserted into the board that raises the board higher off the ground and had a smaller, more challenging rocker curve radius. The rocker module is made of injection molded nylon with reinforcing stringers on the inside and is painted with a non-slip rubberized coating.

The wood board is made of mold pressed laminated plywood, the wood rocker rails and stringers are attached to the deck using countersunk screws and/or wooden pegs and glue. The rubber bumpers are screwed and/or glued to the deck. The cork pad is glued to the surface of the deck, logos are laser etched and/or heat sublimated. The wood balance rails are covered with a non-slip rubber material.

The more challenging rocker modules are made of injection molded fiber reinforced nylon and covered with rubberized paint or other non-slip material. The challenging rocker module fits tightly and can be secured with quick release pins, it can be swapped quickly without using tools.

DETAIL DESCRIPTIONS OF THE INVENTION

Figure 1:
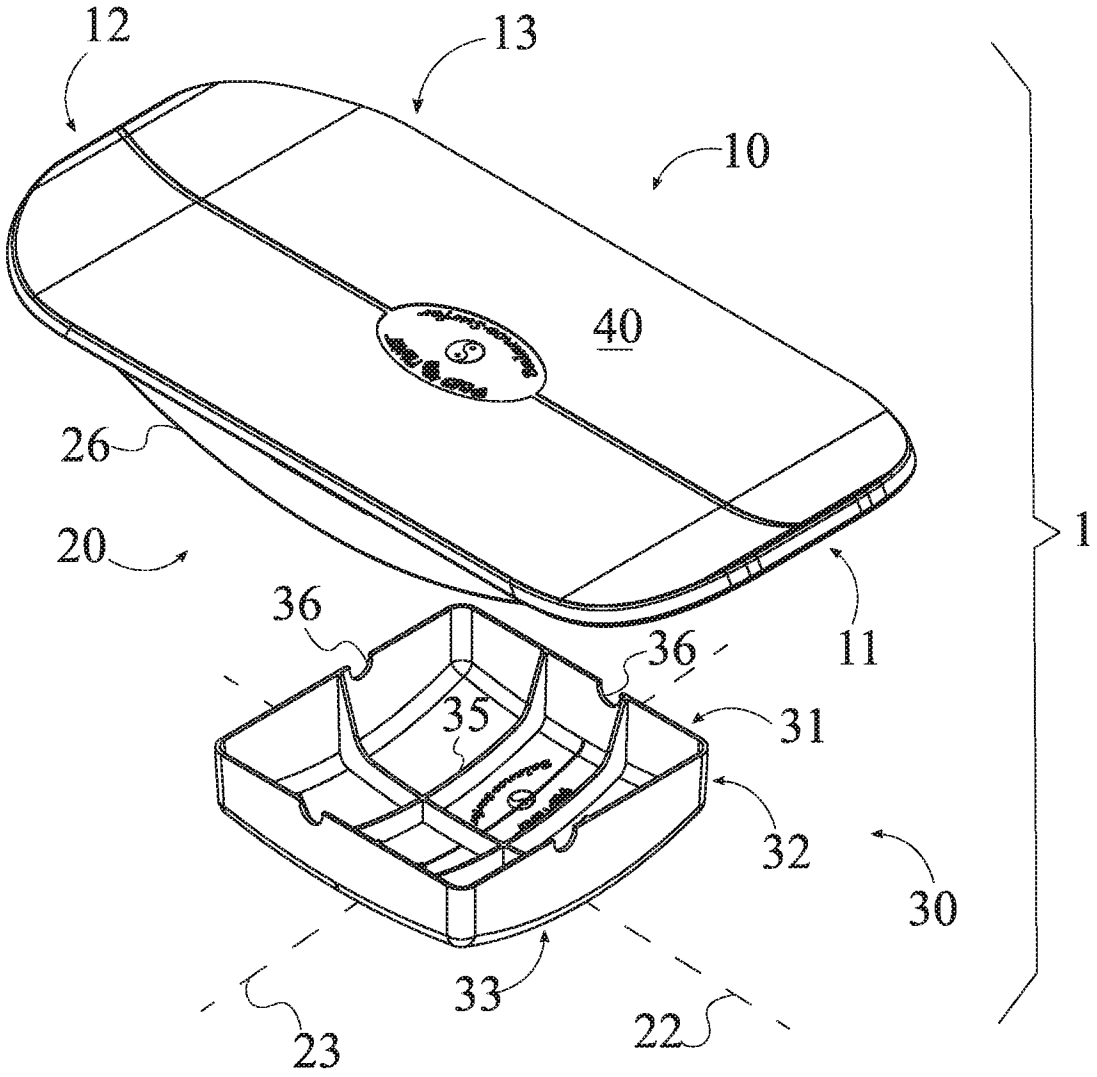
FIG. 1 is a top perspective view of the present invention that shows a fulcrum insert removed.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

In reference to FIGS. 1-6, the balance board apparatus 1 comprises a deck 10, a fulcrum receiver 20, and a fulcrum insert 30. The balance board apparatus 1 is a variable difficulty balance board for standing desk and fitness use. More specifically, the balance board apparatus 1 may take the form of an exercise device suitable for the conditioning and rehabilitation of the user's nerves, muscles, bones, and joints by facilitating or limiting the range of motion and biomechanical forces around the longitudinal and lateral axes. In the preferred embodiment of the present invention, the balance board apparatus 1 may be made out of lightweight and durable material that can withstand the normal and shear forces of the user's weight. The balance board apparatus 1 can be made out of, but not limited to wood, polymer composite, aircraft grade aluminum, carbon fiber, or any other suitable material. In the preferred embodiment of the present invention, the balance board apparatus 1 may take the form of a rectangular shape, but can also employ other shapes such as, but not limited to circular, elliptical, or any other polygonal shape. In various embodiments, the present invention can take the form of any size that complements the users stature.

In reference to FIGS. 1-5, the deck 10 extends between a first deck end 11 and a second deck end 12. In the preferred embodiment of the present invention, the first deck end 11 and the second deck end 12 facilitates the terminally longitudinal length boundaries of the deck 10 such that the first deck end 11 is longitudinally opposite from the second deck end 12.

Figure 2:
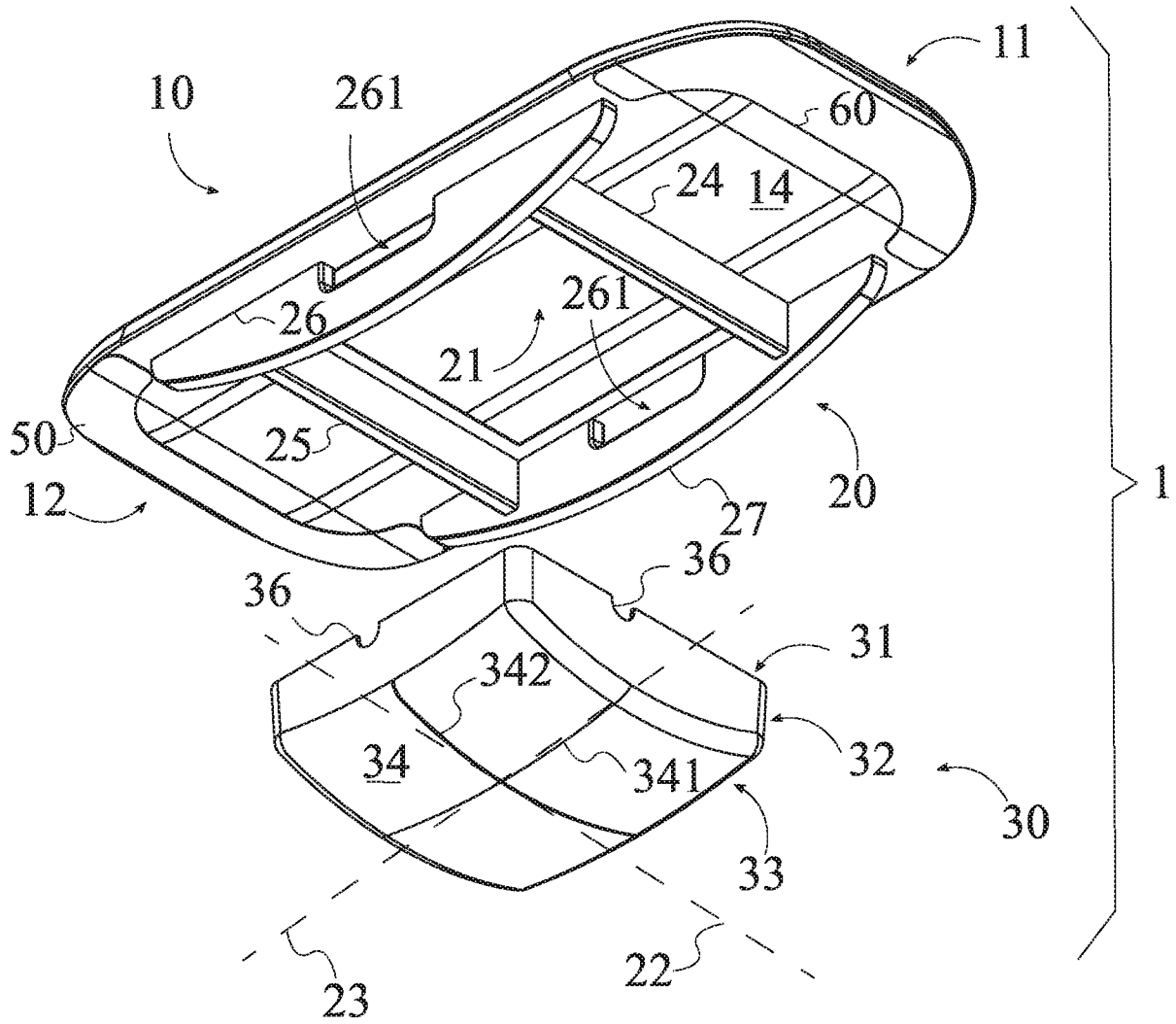
FIG. 2 is a bottom perspective view of the present invention that shows the fulcrum insert removed.

In reference to FIGS. 1-2, the deck 10 comprises a bottom surface 14 and a top surface 13. In the preferred embodiment of the present invention, the bottom surface 14 of the deck 10 may take the form of the mounting surface of the deck 10 that facilitates the mounting of the fulcrum receiver 20. In the preferred embodiment of the present invention, the top surface 13 of the deck 10 is opposite to the bottom surface 14 of the deck 10. The top surface 13 of the deck 10 facilitates the mounting of a grip layer 40. Additionally, the top surface 13 of the deck 10 serves as the engagement surface such that a user can balance their feet on when using the balance board apparatus 1.

Figure 3:
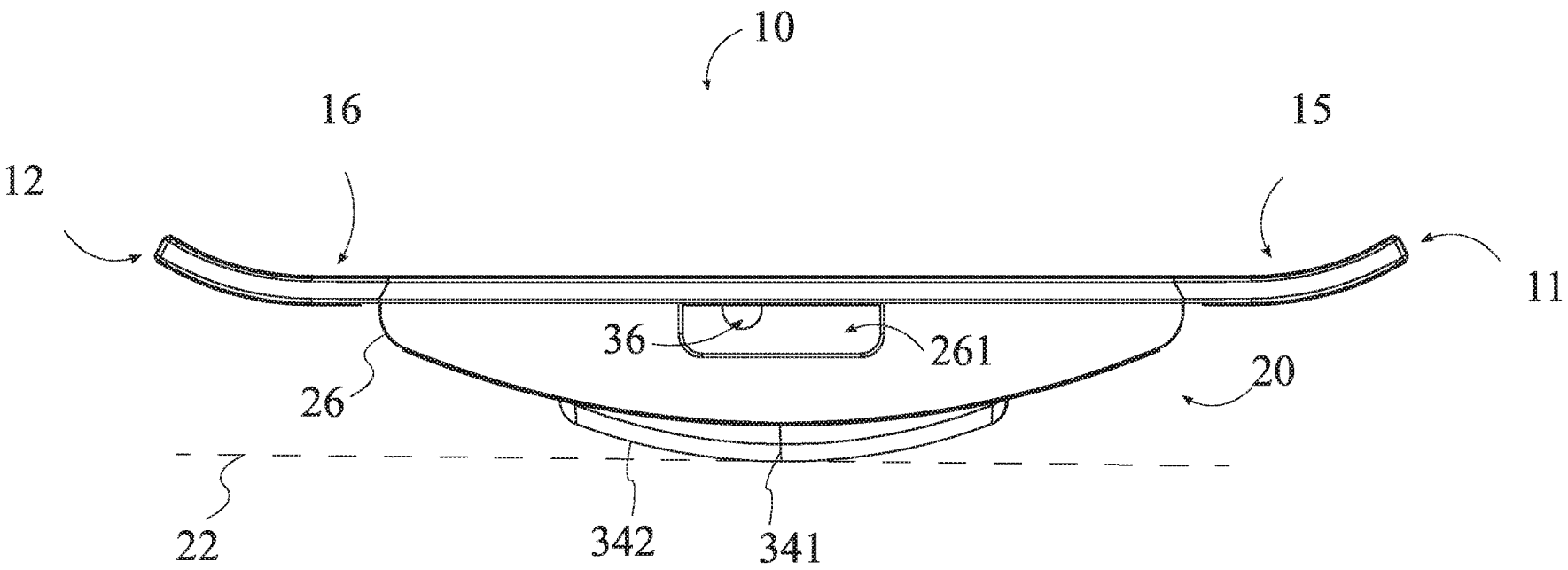
FIG. 3 is a front view of the present invention that shows the fulcrum insert positioned in a first orientation.
Figure 4:
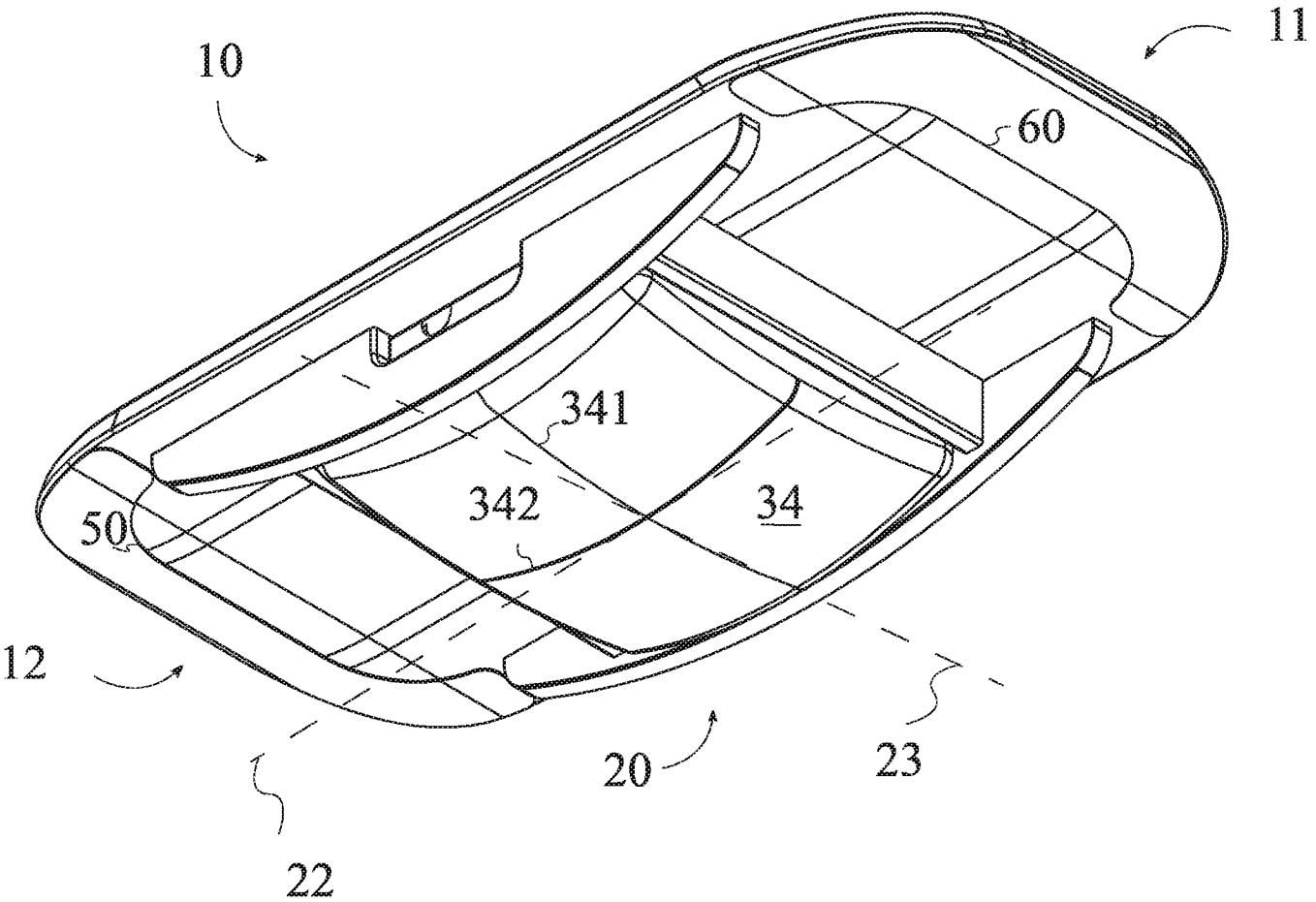
FIG. 4 is a bottom perspective view of the present invention that shows the fulcrum insert positioned in a second orientation.
Figure 5:
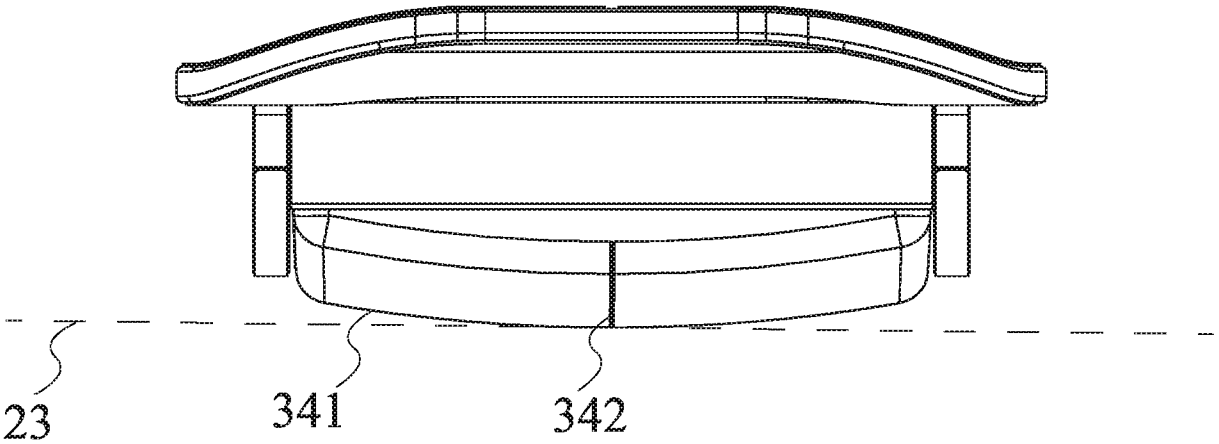
FIG. 5 is a right view of the present invention that shows the fulcrum insert positioned in the second orientation.
Figure 6:
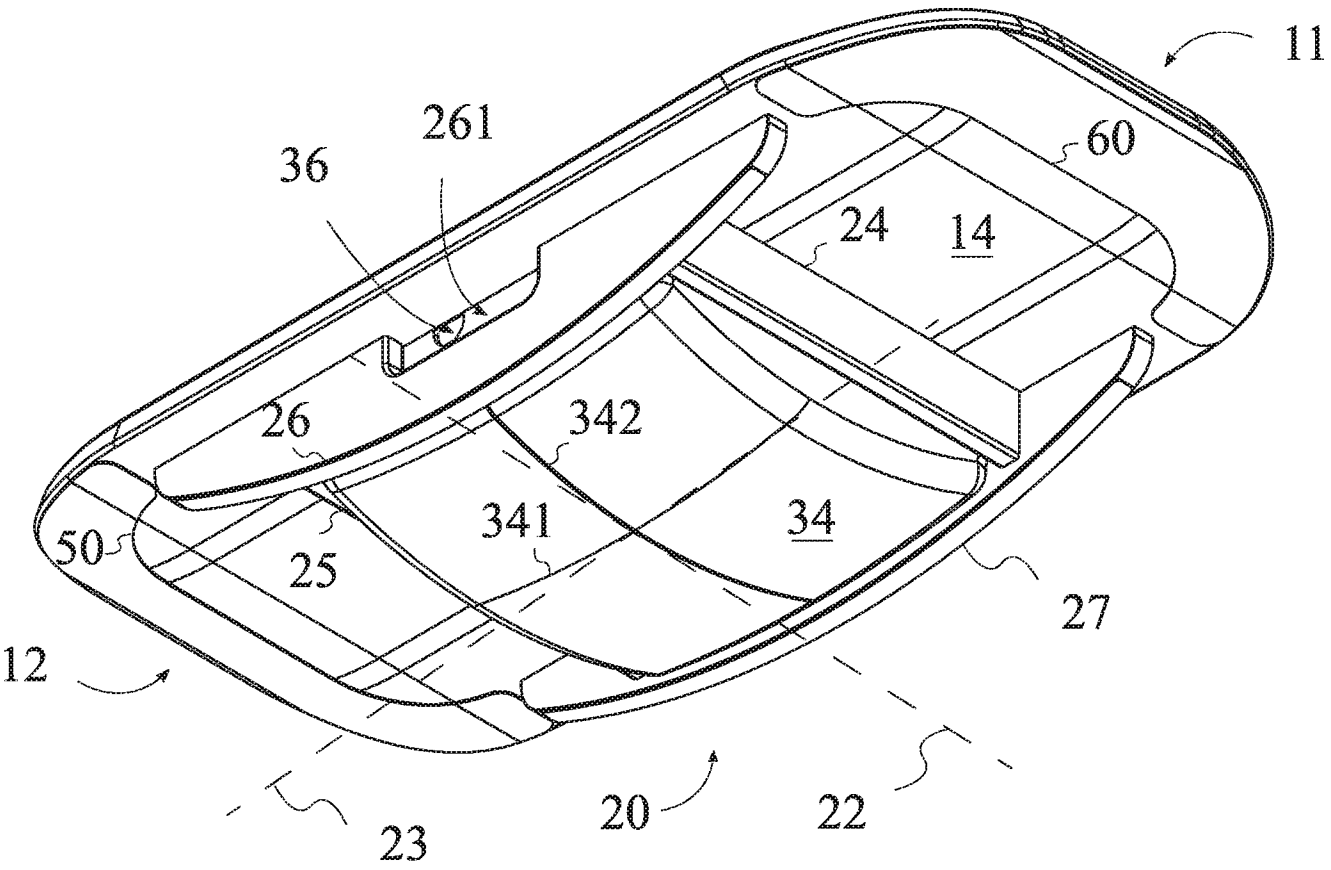
FIG. 6 is a bottom perspective view of the present invention that shows the fulcrum insert being positioned in the second orientation.

In the preferred embodiment of the present invention, the fulcrum receiver 20 is connected adjacent to the bottom surface 14 of the deck 10, as shown in FIGS. 2-4. The fulcrum receiver 20 facilitates the mounting of the fulcrum insert 30. In the preferred embodiment of the present invention, the fulcrum receiver 20 may take the form of a mounting implement that press fits the fulcrum insert 30 but may take the form of any other mounting implement. The fulcrum receiver 20 comprises a fulcrum cavity 21, as shown in FIG. 2. The fulcrum cavity 21 traverses into the fulcrum receiver 20 towards the bottom surface 14. In the preferred embodiment of the present invention, the fulcrum cavity 21 may take the form of the spatial area that facilitates the positioning of the fulcrum insert 30 along the bottom surface 14 of the deck 10. In the preferred embodiment of the present invention, the fulcrum insert 30 is removably positioned within the fulcrum cavity 21 in either a first orientation 22 or a second orientation 23, where the first orientation 22 and the second orientation 23 are perpendicular to each other. More specifically, the first orientation 22 may take the form of a lateral relative positioning of the fulcrum insert 30 along the deck 10, as shown in FIGS. 3-5. The second orientation 23 may take the form of a longitudinal relative positioning of the fulcrum insert 30 along the deck 10, as shown in FIG. 6. In the preferred embodiment of the present invention, the fulcrum insert 30 may be configured in the first orientation 22, allowing the user to balance on the balance board apparatus 1 in a lateral manner, relative to the deck 10. Additionally, the fulcrum insert 30 may be configured in the second orientation 23, allowing the user to balance on the balance board apparatus 1 in a longitudinal manner, relative to the deck 10. In various embodiments, the fulcrum insert 30 may take the form of any type of convex insert that facilitates a longitudinal or lateral balance orientation along the bottom surface 14 of the deck 10. In reference to FIG. 7, the fulcrum insert 30 may take the form of fulcrums of varying convex steepness. In the preferred embodiment of the present invention, the fulcrum insert 30 may take the form of any balancing implementation, such as, but not limited to balancing balls, tips, springs, or any other type of balancing implementation. In the preferred embodiment of the present invention, the fulcrum insert 30 may take the form of an injection molded polymer insert, but may be made out of any other suitable material, such as, but not limited to nylon fiber case injection molding, wood, carbon fiber, aluminum, fiberglass, rubber, silicone or any other suitable material.

In the preferred embodiment of the present invention, the deck 10 further comprises a first curved portion 15 and a second curved portion 16, as shown in FIG. 3. The first curved portion 15 is positioned adjacent to the first deck end 11. The second curved portion 16 is positioned adjacent to the second deck end 12, longitudinally opposite to the first deck end 11. The first curved portion 15 and the second curved portion 16 may take the form of convex bends to the deck 10, relative to the bottom surface 14. The first curved portion 15 and the second curved portion 16 serve as the mounting area for a first pad 50 and a second pad 60. In the preferred embodiment of the present invention, the bottom surface 14 areas of the first deck end 11 and the second deck end 12 are oriented upwards, such that the bottom surface 14 of the first deck end 11 and the second deck end 12 will contact the flat surface that the balance board is positioned to when the balance board is tilted to the first deck end 11 or the second deck end 12, respectively.

In the preferred embodiment of the present invention, the balance board apparatus 1 further comprises a grip layer 40, as shown in FIG. 1. The grip layer 40 is connected across the top surface 13. The grip layer 40 may take the form of a textured sheet that is adhered to the top surface 13 of the deck 10 that secures the user's feet along the top surface 13 of the board when the balance board is in use. In the preferred embodiment of the present invention, the grip layer 40 may take the form of a textured sheet tape, but may take the form of any means of applying a texture on the top surface 13, such as, but not limited to: stippling, molding, rubber, silicone, or any other means of applying an anti-shear texture along the top surface 13 of the board.

In the preferred embodiment of the present invention, the balance board apparatus 1 further comprises a first pad 50, and a second pad 60, as shown in FIGS. 2-4 In the preferred embodiment of the present invention, the first pad 50 and the second pad 60 are connected adjacent to the bottom surface 14. The first pad 50 is positioned adjacent to the first deck end 11. The second pad 60 is positioned adjacent to the second deck end 12. The first pad 50 and the second pad 60 may take the form of shock absorbing protective sheets that protects the first end and the second end portions of the balance board apparatus 1 from damage when the balance board apparatus 1 is tilted out of balance such that the first deck end 11 or the second deck end 12 contacts the flat surface the balance board is positioned to. In the preferred embodiment of the present invention, the first pad 50 and the second pad 60 may take the form of anti-skid, shock absorbing layering, but may take the form of any other suitable material of similar properties, such as but not limited to: rubber bumpers, silicone pads, buffer springs, or any other means.

In the preferred embodiment of the present invention, the fulcrum receiver 20 further comprises a first frame portion 24, a second frame portion 25, a first rocker 26, and a second rocker 27, as shown in FIGS. 2-3. The first frame portion 24 is positioned between the first deck end 11 and the second frame portion 25. The second frame portion 25 is positioned between the second deck end 12 and the first frame portion 24. The first frame portion 24 and the second frame portion 25 are perpendicularly connected between the first rocker 26 and the second rocker 27. In the preferred embodiment of the present invention, the first frame portion 24 and the second frame portion 25 serve as the lateral boundary panels that secures the fulcrum insert 30 to the bottom surface 14 of the deck 10. In reference to FIGS. 2, and 4-6, the first rocker 26 and the second rocker 27 traverses along the bottom surface 14. The first rocker 26 and the second rocker 27 are positioned between the first deck end 11 and the second deck end 12. In the preferred embodiment of the present invention, the first rocker 26 and the second rocker 27 serves as the longitudinal boundary panels that secures the fulcrum insert 30 to the bottom surface 14 of the deck 10. Additionally, the first rocker 26 and the second rocker 27 serve as an integrated fulcrum built into the balance board apparatus 1 when the fulcrum insert 30 is removed from the fulcrum cavity 21. In this configuration, the balance board apparatus 1 is set to its default balance orientation. More specifically, the default balance orientation may take the form of a longitudinal balance fulcrum, relative to the deck 10. In the preferred embodiment of the present invention, the fulcrum cavity 21 is delineated by the first frame portion 24, the second frame portion 25, the first rocker 26, and the second rocker 27.

In reference to FIGS. 2-3, and 6, the first rocker 26 and the second rocker 27 each comprise an aperture 261. The aperture 261 traverses through the first rocker 26 and the second rocker 27. The aperture 261 is positioned between the first frame portion 24 and the second frame portion 25. In the preferred embodiment of the present invention, the aperture 261 may take the form of an access opening to facilitate the removal of the fulcrum insert 30 installed into the fulcrum receiver 20. Additionally, the aperture 261 allows the first rocker 26 and the second rocker 27 to serve as carrying handles, allowing the user to grasp the first rocker 26 or the second rocker 27 along the aperture 261 portion to carry the balance board apparatus 1.

In the preferred embodiment of the present invention, the fulcrum insert 30 further comprises a fulcrum brim 31, fulcrum body 32, and a fulcrum base 33, as shown in FIGS. 1-2. In the preferred embodiment of the present invention, the fulcrum brim 31 is perimetrically aligned to the fulcrum cavity 21, as shown in FIG. 2. The fulcrum brim 31 serves as the mounting portion of the fulcrum insert 30 that installs to the fulcrum receiver 20. In the preferred embodiment of the present invention, the fulcrum brim 31 may take the form of a square shaped profile but may take the form of any other suitable shape.

In reference to FIGS. 1-2, the fulcrum body 32 is positioned between the fulcrum brim 31 and the fulcrum base 33. The fulcrum body 32 serves as the chassis portion of the fulcrum insert 30 that provides structural support to the fulcrum brim 31 and the fulcrum base 33. In the preferred embodiment of the present invention, the fulcrum insert 30 further comprises an infill 35, as shown in FIG. 1. The infill 35 is positioned within the fulcrum insert 30. The infill 35 may take the form of interior structural struts that reside within the fulcrum body 32. The infill 35 reinforces the fulcrum insert 30 from buckling when subjected to normal and shear forces exerted by the user. In the preferred embodiment of the present invention, the infill 35 may take the form of any suitable means of supporting the fulcrum insert 30 such as, but not limited to solid cast molding, foam, or any other suitable type of structural reinforcement.

In the preferred embodiment of the present invention, the fulcrum insert 30 further comprises a plurality of cut-outs 36, as shown in FIGS. 1-3, and 5. The plurality of cut-outs 36 traverses through the fulcrum brim 31. The plurality of cut-outs 36 may take the form of access ports that allows the user to remove the press-fit fulcrum insert 30 installed within the fulcrum receiver 20.

Figure 7:
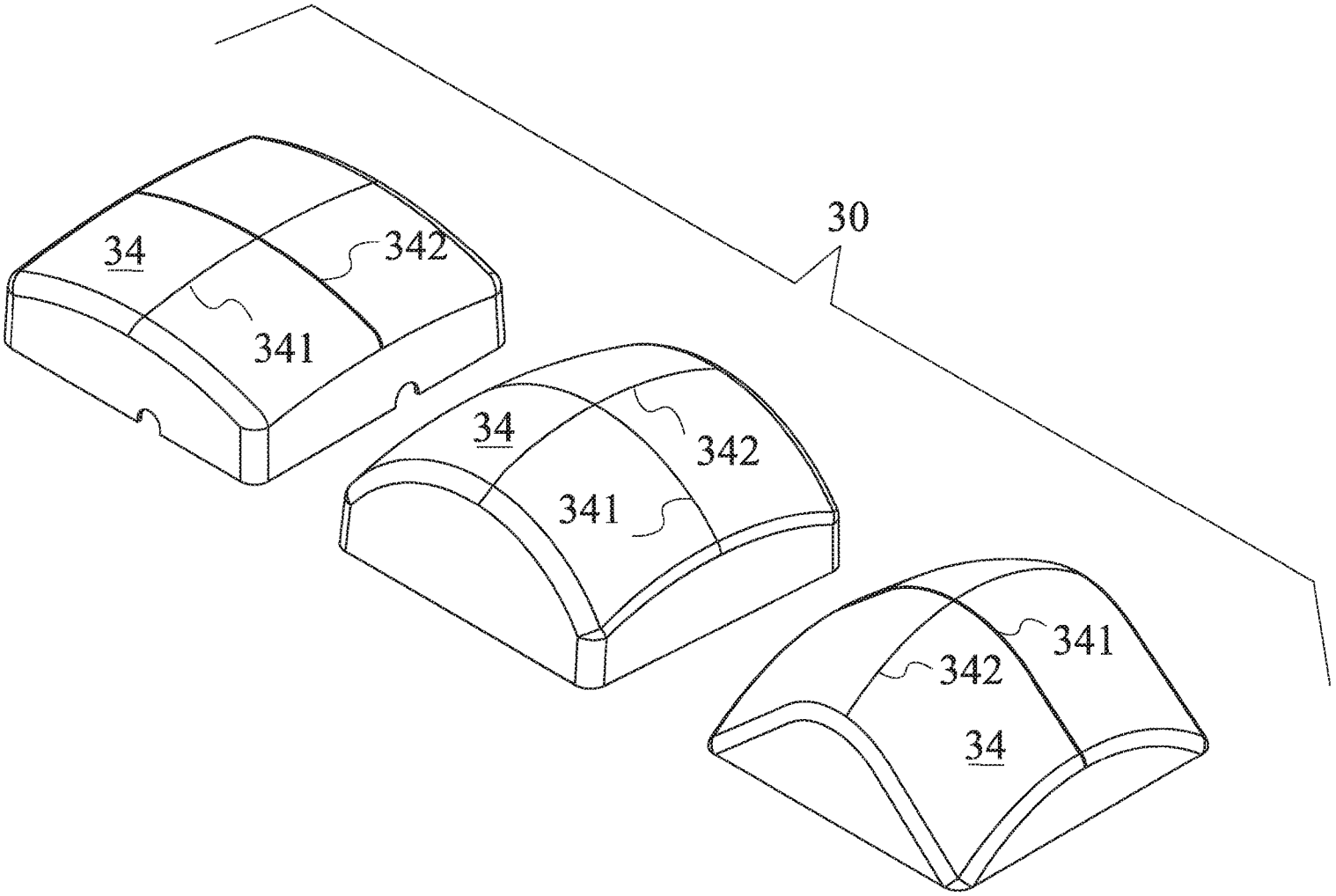
FIG. 7 is a perspective view of varying degrees of fulcrum inserts used in the present invention.

In the preferred embodiment of the present invention, the fulcrum base 33 is positioned adjacent to the fulcrum body 32, opposite to the fulcrum brim 31, as shown in FIGS. 1-2. The fulcrum base 33 serves as the portion of the fulcrum insert 30 that contacts the flat surface the balance board apparatus 1 is rested on. In the preferred embodiment of the present invention, the fulcrum base 33 is a convex surface 34, as shown in FIGS. 2-3, and 7. In various embodiments, the fulcrum base 33 portion of the fulcrum insert 30 may take the form of any degree of convex surface 34, as shown in FIG. 7. In various embodiments, the fulcrum base 33 portion of the fulcrum insert 30 may take the form of any suitable balancing implement, such as but not limited to balls, springs, or any other suitable balancing implement.

In the preferred embodiment of the present invention, the convex surface 34 comprises a longitudinal curvature 341 and a lateral curvature 342, as shown in FIGS. 2-7. In the preferred embodiment of the present invention, the longitudinal curvature 341 and the lateral curvature 342 are dissimilar from each other, as shown in FIG. 7. In another embodiment, the longitudinal curvature 341 and the lateral curvature 342 are the same. The longitudinal curvature 341 serves as the fulcrum balance axis relative to the deck 10 longitudinal profile. The lateral curvature 342 serves as the fulcrum balance axis relative to the deck 10 lateral profile.

In the preferred embodiment of the present invention, the balance board apparatus 1 instability stems from the curved surface extending outwards from the bottom surface 14 of the deck 10. In reference to FIGS. 1-2, and 7, the easiest balance setting of having the fulcrum insert 30 removed from the fulcrum receiver only allows only longitudinal rocking motion at a bigger curve radius that is easier to balance on. In various embodiments, the fulcrum insert 30 may take the form of different convex surfaces 34 such that more difficult balance settings raise the balance board higher off the ground and have a smaller rocker radius that makes balancing more challenging. The more difficult settings allow left to right and front to back rocking motion, for a 360-degree balance challenge.

Figure 8:
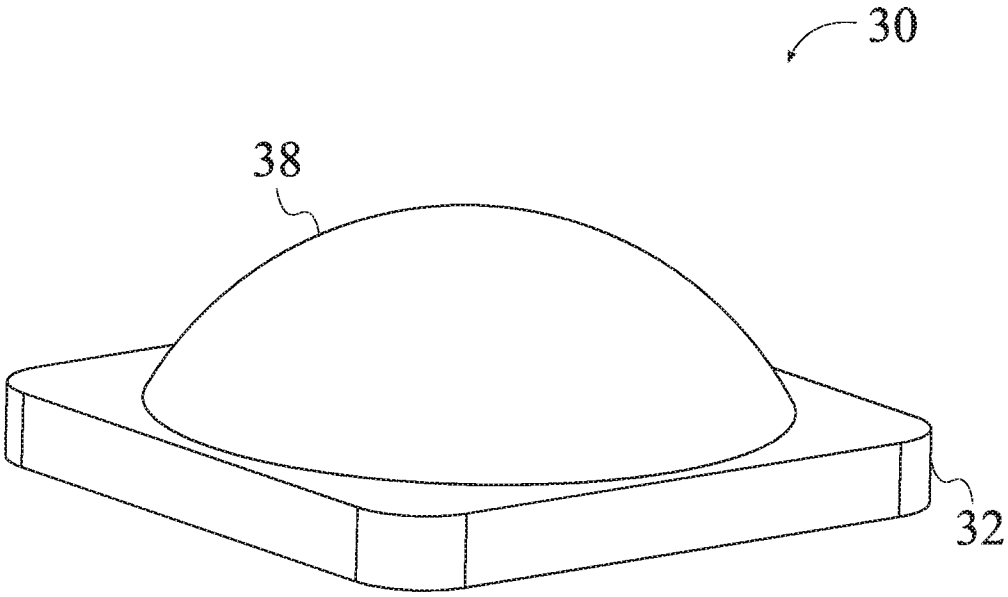
FIG. 8 is a perspective view of an inflatable bladder used in the present invention.
Figure 9:
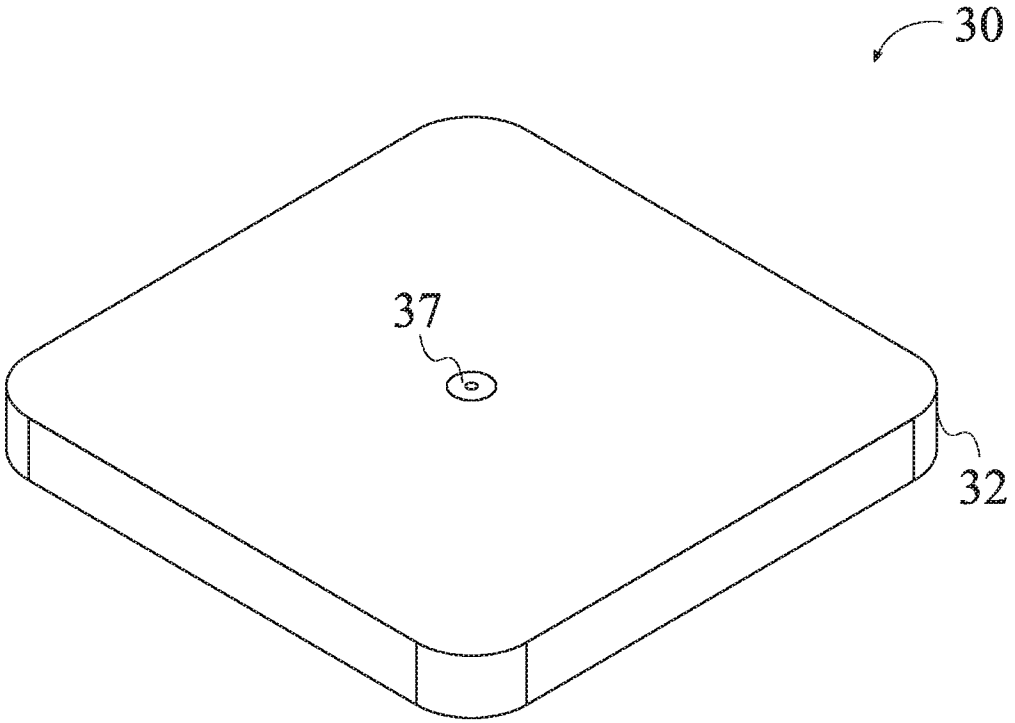
FIG. 9 is a perspective view of a pressure valve used in the present invention.

In another embodiment, the fulcrum insert 30 further comprises a pressure valve 37, the fulcrum body 32, and an inflatable bladder 38, as shown in FIGS. 8-9. The inflatable bladder 38 is connected adjacent to the fulcrum body 32. The pressure valve 37 is in fluid communication with the inflatable bladder 38. In this embodiment, the fulcrum insert 30 may take the form of an adjustable fulcrum insert 30, such that the user can adjust the degree of balancing difficulty of the fulcrum insert 30 by inputting more or less air pressure within the inflatable bladder through the pressure valve 37.

Although the invention has been explained in relation to its preferred embodiment, it is to be understood that many other possible modifications and variations can be made without departing from the spirit and scope of the invention as hereinafter claimed.

What is claimed is:

1. A balance board apparatus comprising:

a deck;

a fulcrum receiver;

a fulcrum insert;

the deck extending between a first deck end and a second deck end;

the deck comprising a bottom surface and a top surface;

the fulcrum receiver being connected adjacent to the bottom surface of the deck;

the fulcrum receiver comprising a fulcrum cavity;

the fulcrum cavity traversing into the fulcrum receiver towards the bottom surface;

the fulcrum insert being removably positioned within the fulcrum cavity in either a first orientation or a second orientation, wherein the first orientation and the second orientation are perpendicular to each other;

the fulcrum receiver further comprising a first frame portion, a second frame portion, a first rocker, and a second rocker;

the first frame portion being positioned between the first deck end and the second frame portion;

the second frame portion being positioned between the second deck end and the first frame portion;

the first rocker and the second rocker traversing along the bottom surface;

the first rocker and the second rocker being positioned between the first deck end and the second deck end;

the first frame portion and the second frame portion being perpendicularly connected between the first rocker and the second rocker; and the fulcrum cavity being delineated by the first frame portion, the second frame portion, the first rocker, and the second rocker.

2. The balance board apparatus as claimed in claim 1 comprising:

the deck further comprising a first curved portion and a second curved portion;

the first curved portion being positioned adjacent to the first deck end; and the second curved portion being positioned adjacent to the second deck end.

3. The balance board apparatus as claimed in claim 1 comprising:

a grip layer; and the grip layer being connected across the top surface.

4. The balance board apparatus as claimed in claim 1 comprising:

a first pad;

a second pad;

the first pad and the second pad being connected adjacent to the bottom surface;

the first pad being positioned adjacent to the first deck end; and the second pad being positioned adjacent to the second deck end.

5. The balance board apparatus as claimed in claim 1 comprising:

the first rocker and the second rocker each comprising an aperture;

the aperture traversing through the first rocker and the second rocker; and the aperture being positioned between the first frame portion and the second frame portion.

6. The balance board apparatus as claimed in claim 1 comprising:

the fulcrum insert further comprising a fulcrum brim, fulcrum body, and a fulcrum base;

the fulcrum brim being perimetrically aligned to the fulcrum cavity; and the fulcrum body being positioned between the fulcrum brim and the fulcrum base.

7. The balance board apparatus as claimed in claim 6 comprising:

the fulcrum insert further comprising an infill; and the infill being positioned within the fulcrum insert.

8. The balance board apparatus as claimed in claim 6 comprising:

the fulcrum insert further comprising a plurality of cut-outs; and the plurality of cut-outs traversing through the fulcrum brim.

9. The balance board apparatus as claimed in claim 6, wherein the fulcrum base is a convex surface.

10. The balance board apparatus as claimed in claim 9 comprising:

the convex surface comprising a longitudinal curvature and a lateral curvature; and the longitudinal curvature and the lateral curvature being dissimilar from each other.

11. The balance board apparatus as claimed in claim 1 comprising:

the fulcrum insert further comprising a pressure valve, a fulcrum body, and an inflatable bladder;

the inflatable bladder being connected adjacent to the fulcrum body; and the pressure valve being in fluid communication with the inflatable bladder.

* * * * *